US009190743B2

(12) United States Patent
Sato et al.

(10) Patent No.: US 9,190,743 B2
(45) Date of Patent: Nov. 17, 2015

(54) ELECTRIC WIRE CONNECTION STRUCTURE OF CONNECTOR TERMINAL

(71) Applicant: YAZAKI CORPORATION, Tokyo (JP)

(72) Inventors: Kei Sato, Shizuoka (JP); Shinji Kodama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 73 days.

(21) Appl. No.: 13/860,308

(22) Filed: Apr. 10, 2013

(65) Prior Publication Data

US 2013/0225014 A1 Aug. 29, 2013

Related U.S. Application Data

(63) Continuation of application No. PCT/JP2011/071270, filed on Sep. 16, 2011.

(30) Foreign Application Priority Data

Oct. 12, 2010 (JP) ..... 2010-229959

(51) Int. Cl.
*H01R 4/62* (2006.01)
*H01R 4/70* (2006.01)
*H01R 4/18* (2006.01)

(52) U.S. Cl.
CPC . *H01R 4/70* (2013.01); *H01R 4/185* (2013.01)

(58) Field of Classification Search
CPC ..... H01R 4/62; H01R 4/70; H01R 4/185
USPC ..... 439/203, 604, 877
IPC ..... H01R 4/62, 4/20, 4/185, 43/24, 13/5845, H01R 13/5205, 13/5216
See application file for complete search history.

(56) References Cited

U.S. PATENT DOCUMENTS

| | | | | |
|---|---|---|---|---|
| 5,123,864 | A * | 6/1992 | Karlovich | 439/585 |
| 6,004,171 | A | 12/1999 | Ito et al. | |
| 6,517,381 | B2 * | 2/2003 | Kondo | 439/604 |
| 7,690,954 | B2 * | 4/2010 | Watanabe et al. | 439/730 |
| 8,039,746 | B2 * | 10/2011 | Ashida et al. | 174/88 R |
| 8,480,421 | B2 * | 7/2013 | Yoshioka et al. | 439/275 |
| 8,607,449 | B2 * | 12/2013 | Kitagawa et al. | 29/863 |

(Continued)

FOREIGN PATENT DOCUMENTS

| | | |
|---|---|---|
| CN | 1725559 A | 1/2006 |
| CN | 101151769 A | 3/2008 |

(Continued)

OTHER PUBLICATIONS

ISA210 and 230 for PCT/JP2011/071270 dated Oct. 25, 2011.

(Continued)

*Primary Examiner* — Hien Vu
(74) *Attorney, Agent, or Firm* — Kenealy Vaidya LLP

(57) ABSTRACT

A conductor (Wa) of the electric wire (W) whose insulated sheath (Wb) is removed from an extremity of the conductor to a location where the conductor projects backwards from a rear end of the terminal accommodating chamber (11) of the connector housing 10 is crimped and connected by means of a pair of crimping pieces (3*b*), and an area that ranges from the extremity of the conductor (Wa) to the location that includes an end of the insulated sheath (Wb) is covered with a resin (8).

12 Claims, 14 Drawing Sheets

(56) References Cited

U.S. PATENT DOCUMENTS

| | | | |
|---|---|---|---|
| 2005/0026515 | A1 | 2/2005 | Hashimoto et al. |
| 2009/0229880 | A1 | 9/2009 | Watanabe |
| 2011/0225820 | A1 | 9/2011 | Kondo et al. |

FOREIGN PATENT DOCUMENTS

| | | | |
|---|---|---|---|
| JP | 51-7512 | Y1 | 2/1976 |
| JP | 1-241768 | A | 9/1989 |
| JP | 4-123780 | A | 4/1992 |
| JP | 7-135031 | A | 5/1995 |
| JP | 10-255864 | A | 9/1998 |
| JP | 2005-50736 | A | 2/2005 |
| JP | 2010-97704 | A | 4/2010 |
| JP | 2010-108828 | A | 5/2010 |
| WO | 2007/043345 | A1 | 4/2007 |
| WO | 2009/081798 | A1 | 7/2009 |
| WO | 2009/115860 | A1 | 9/2009 |

OTHER PUBLICATIONS

Korean Office Action for the related Korean Patent Application No. 10-2013-7009272 dated Feb. 27, 2014.

Chinese Office Action for the related Chinese Patent Application No. 201180049485.8 dated Jan. 6, 2015.

* cited by examiner

ELECTRIC WIRE CONNECTION STRUCTURE OF CONNECTOR TERMINAL

CROSS REFERENCE TO RELATED APPLICATION

This application is a continuation of PCT application No. PCT/JP2011/071270, which was filed on Sep. 16, 2011 based on Japanese Patent Application No. 2010-229959 filed on Oct. 12, 2010, the contents of which are incorporated herein by reference. Also, all the references cited herein are incorporated as a whole.

BACKGROUND OF THE INVENTION

1. Field of the Invention

The present invention relates to an electric wire connection structure of a connector terminal to be inserted into a terminal accommodating chamber of a connector housing from behind.

2. Description of the Related Art

Like an example shown in FIG. 14, a common connector terminal 201 has on its front side an electric connection section 202 to be connected to an un-illustrated counterpart terminal, and the like. Further, the common connector terminal 201 has on its rear side a front-side conductor crimping section 203 and a rear-side cladding crimping section 204 as an electric wire connection section to be crimped and connected to an end of an electric wire W. The conductor crimping section 203 is formed from a bottom plate (not shown) and a pair of crimping pieces 203*b* and 203*b* that are upwardly extended from both side edges of the bottom plate, so as to substantially assume the shape of letter U when viewed in cross section. The cladding crimping section 204 is formed from the bottom plate (not shown) and a pair of crimping pieces 204*b* and 204*b* that are upwardly extended from both side edges of the bottom plate, so as to substantially assume the shape of letter U when viewed in cross section. The conductor crimping section 203 and the cladding crimping section 204 have the continual bottom plate in common.

In order to connect the connector terminal 201 of this type to the end of the electric wire W, an insulated sheath Wb of the electric wire W is cut by a length required to be crimped to the conductor crimping section 203, thereby making a conductor Wa in the insulated sheath Wb exposed. The thus-exposed conductor Wa is put on the bottom plate of the conductor crimping section 203, and a portion of the conductor Wa covered with the insulated sheath Wb is also put on the bottom plate of the cladding crimping section 204. The pair of crimping pieces 203*b*, 203*b* of the conductor crimping section 203 and the pair of crimping pieces 204*b*, 204*b* of the cladding crimping section 204 are inwardly rounded, thereby crimping the crimping pieces so as to enwrap the conductor Wa and the portion of the conductor Wa covered with the insulated sheath Wb. The connector terminal 201 and the electric wire W can thereby be connected to each other.

Subsequently, the conductor Wa is, in case of necessity, protected against corrosion and waterproofed by molding or coating a connected portion of the electric wire with a resin 8 so as to cover the entirety of the exposed portion of the conductor Wa. In particular, when the conductor Wa of the electric wire W is formed from aluminum or an aluminum alloy, such resin sealing is practiced. For instance, when the connector terminal is formed from copper or a copper alloy, a junction between dissimilar metals might undergo electric corrosion when moisture attaches to the junction. The junction is covered with the resin 8 to prevent electric corrosion.

Covering an electric-wire-connected portion of a terminal with a resin has widely been known in; for instance, JP-A-2010-97704.

Incidentally, when the electric wire connection portion of the terminal is covered with a resin in a manner as mentioned above, a cross section of the covered portion becomes larger. Accordingly, when the terminal is about to be inserted into the terminal accommodating chamber of the connector housing, the portion covered with the resin interferes with the connector housing, which often poses difficulty on or impedes insertion of the terminal. In particular, the portion of the terminal whose cross section becomes largest corresponds to an area where the portion of the electric wire connection portion covered with the insulated sheath is further coated with the resin. When this portion becomes too large, ease of insertion of the terminal into the terminal accommodating chamber becomes often deteriorated.

The present invention has been conceived in light of the circumstance and aims at providing an electric wire connection structure of a connector terminal that enables easy insertion of a terminal into a terminal accommodating chamber of a connector housing even when an electric wire connection portion is coated with a resin.

SUMMARY OF THE INVENTION

In order to accomplish the objective, an electric wire connection structure of a connector terminal of the present invention is characterized by items (1) to (7) provided below.

(1) An electric wire connection structure of a connector terminal in which an end of an electric wire is crimped and connected to a rear end of a connector terminal to be inserted, from behind, into a terminal accommodating chamber of a connector housing, wherein the connector terminal has in a front portion an electric connection section for connection with a counterpart terminal and in a rear portion an electric wire connection section to be crimped and connected to the end of the electric wire, and the electric wire connection section is formed so as to assume a substantially U-shaped profile when viewed in cross section, from a bottom plate and a pair of crimping pieces that extend upwards from both side edges of the bottom plate;

an insulated sheath of the end of the electric wire is removed from an extremity of the electric wire to a location where the electric wire projects backwards from a rear end of the terminal accommodating chamber of the connector housing;

a conductor of the electric wire that is exposed by removal of the insulated sheath is put on an upper surface of the bottom plate of the electric wire connection section, and the pair of crimping pieces of the electric wire connection section are curled inwardly so as to enwrap the conductor, whereby the conductor is crimped and connected so as to come into close contact with the upper surface of the bottom plate, and an area that ranges from an extremity of the conductor to a location including an edge of the insulated sheath by way of a portion of the conductor connected to the electric wire connection section is covered with a resin.

(2) In the electric wire connection structure of the connector terminal having a configuration described in connection with (1), the electric wire connection section has in a front portion a first conductor crimping section and in a rear portion a second conductor crimping section;

the first conductor crimping section has a bottom plate and a pair of conductor crimping pieces that extend upwards from both side edges of the bottom plate, and the second conductor crimping section has a bottom plate and a pair of conductor crimping pieces that extend upwards from both side edges of the bottom plate; and an area that ranges from the bottom plate of the first conductor crimping section to the bottom plate of the second conductor crimping section is formed as a common bottom plate.

(3) An electric wire connection structure of a connector terminal in which an end of an electric wire is connected to a rear end of a connector terminal to be inserted, from behind, into a terminal accommodating chamber of a connector housing, wherein the connector terminal has in a front portion an electric connection section for connection with a counterpart terminal and in a rear portion an electric wire connection section to be crimped and connected to the end of the electric wire, and the electric wire connection section is formed so as to assume a substantially U-shaped profile when viewed in cross section, from a bottom plate and a pair of crimping pieces that extend upwards from both side edges of the bottom plate;

a conductor of the end of the electric wire and a portion of the conductor covered with an insulated sheath are put on an upper surface of the bottom plate of the electric wire connection section, and the pair of crimping pieces of the electric wire connection section are inwardly curled so as to enwrap the conductor and a portion of the conductor covered with the insulated sheath, whereby the conductor and the portion of the conductor covered with the insulated sheath are crimped so as to come into close contact with the upper surface of the bottom plate, and such that a cross section of the area crimped so as to enwrap the portion of the conductor covered with the insulated sheath becomes smaller than a cross section of the electric wire that extends backwards from the electric wire connection section.

(4) In the electric wire connection structure of the connector terminal having the configuration described in connection with (3), an extent from an extremity of the conductor to a location including a rear end of the electric wire connection is covered with a resin.

(5) In the electric wire connection structure of the connector terminal having the configuration described in connection with (3), a chamfered portion is provided in each of corners where upper edges and rear edges of the pair of crimping pieces cross each other.

(6) In the electric wire connection structure of the connector terminal described in connection with (3), raised or indented strips that extend in a direction crossing a longitudinal direction of the electric wire are provided in an area of an interior surface of the electric wire connection section that is to contact a portion of the conductor covered with the insulated sheath, and the raised or indented strips bite into the insulated sheath as a result of the pair of crimping pieces being crimped to the conductor and the portion of the conductor covered with the insulated sheath.

(7) In the electric wire connection structure of the connector terminal described in connection with (1) or (3), a cross section of the electric wire connection section to which the end of the electric wire is crimped and connected is substantially equal to or smaller than a cross section of the electric connection section.

In the electric wire connection structure of the connector terminal having the configuration described in connection with (1), the insulated sheath of the electric wire is removed from the extremity of the end of the electric wire up to the location where the electric wire projects backward from the rear end of the terminal accommodating chamber of the connector housing. Therefore, the portion of the electric wire accommodated in the terminal accommodating chamber serves as a mere conductor without an insulated sheath. Specifically, when the electric wire is accommodated in the terminal accommodating chamber and crimped by the connector terminal while the portion of the electric wire covered with the insulated sheath is accommodated, a cross section of the crimped portion of the electric wire becomes larger by an amount corresponding to the thickness of the insulated sheath. In contrast, when the connector terminal is crimped to solely the conductor without the insulated sheath, the cross section of the crimped portion of the electric wire can be reduced by an amount corresponding to the thickness of the thus-removed insulated sheath.

Consequently, even when the connection between the connector terminal and the electric wire is additionally coated with a sealing resin, the cross section of the connector terminal including the resin can be kept small, so that the connector terminal can be easily, smoothly inserted into the terminal accommodating chamber of the connector housing. This also enables a contribution to miniaturization of the connector. Since the portion of the electric wire that projects from the rear end of the connector terminal is only the conductor, the portion can be coated with a resin to a thickness tantamount to the thickness of the insulated sheath. A bottom side of the electric wire which is contiguous to a bottom of the connector terminal can also be coated with the resin, so that the entire circumference of the conductor can be wrapped with the resin, and the exposed portion of the conductor can be protected by the resin without fail.

Accordingly, when the connector terminal and the conductor of the electric wire are formed from dissimilar metals, electrical corrosion of a contact between the dissimilar metals can be inhibited by means of a sealing effect of the resin. Further, since the entirety of the exposed portion of the conductor is covered with the resin, corrosion of the conductor can be inhibited, and waterproofing the electric wire (preventing intrusion of water among core wires of the conductor) also becomes feasible.

Since the sealing resin covers an extent from the extremity of the conductor to the position including the end of the insulated sheath formed after removal, the strength and flexibility of only the conductor in the extent from the rear end of the connector terminal to the end of the insulated sheath formed after removal can be compensated for by the coating resin. Further, even when the electric wire is bent, the conductor can be protected flexibly by the resin.

In the electric wire connection structure of the connector terminal having the configuration described in connection with (2), the electric wire connection section is made up of the first conductor crimping section and the second conductor crimping section, so that force for supporting the conductor can be enhanced.

In the electric wire connection structure of the connector terminal having the configuration described in connection with (3), the portion of the end of the electric wire covered with the insulated sheath is crimped along with the exposed conductor by means of the electric wire connection section such that a cross section of the crimped portion covered with the insulated sheath becomes smaller than a cross section of the electric wire that extends backwards from the electric wire connection section. Therefore, even when the electric wire connection section is coated with a resin, the cross section of the electric wire including the resin can be kept small, so that insertion of the connector terminal into the terminal accommodating chamber of the connector housing can be easily, smoothly performed. Further, since the portion of the conductor covered with the insulated sheath is also crimped by the electric wire connection section along with the conductor, the exposed portion of the conductor can be minimized, so that the connection section can be protected against corrosion. Therefore, even when the conductor is covered with a resin, operation for molding and coating the resin can be readily performed.

In the electric wire connection structure of the connector terminal having the configuration defined in (4), an extent from the extremity of the conductor to the position including the rear end of the electric wire connection section is covered with the resin, and hence the connection section between the conductor and the connector terminal can be protected against electrical corrosion.

In the electric wire connection structure of the connector terminal having the configuration defined in (5), the chamfered portion is provided in each of the corners where upper edges and rear edges of the pair of crimping pieces cross each other. Therefore, an extent to which the corners of the crimping pieces bite into the electric wire is diminished, thereby inhibiting the insulated sheath of the electric wire from subjecting to flaws.

In the electric wire connection structure of the connector terminal having the configuration defined in (6), the raised or indented strips on the interior surface of the electric wire connection section bite into the insulated sheath of the electric wire. Hence, adhesion between the interior surface of the electric wire connection section and the insulated sheath can be enhanced. Furthermore, the raised or indented strips extend in a direction crossing a longitudinal direction of the electric wire. Even when water is about to enter deep into the conductor from the rear end of the electric wire connection section, a channel of intrusion of water can be shut off by means of a complicate contact structure formed as a result of the raised or indented strips biting into the insulated sheath, so that intrusion of water can be blocked, and corrosion of the conductor can be inhibited.

In the electric wire connection structure of the connector terminal having the configuration described in connection with (7), a cross section of the electric wire connection section to which the end of the electric wire is crimped and connected is substantially equal to or smaller than a cross section of the electric connection section. Therefore, the electric wire connection section and its neighborhood would not interfere with the connector housing when the terminal is inserted into the terminal accommodating chamber of the connector housing, and easy insertion of the connector terminal can be effected.

According to the present invention, even when the electric-wire-connected portion is covered with a resin, a connector terminal can be readily inserted into a terminal accommodating chamber of the connector housing. In a state where the connector terminal remains accommodated in the connector housing, there can be eliminated the possibility of corrosion of a conductor of an electric wire or electrical corrosion of a junction, which would otherwise occur when the terminal and the conductor of the electric wire are formed from dissimilar metals, and waterproofness of the conductor can also be enhanced.

The present invention has been briefly described above. Details of the present invention will become clearer by reading through embodiments for implementing the present invention to be described below with reference to the accompanying drawings.

DESCRIPTION OF THE PREFERRED EMBODIMENTS

Embodiments of the present invention are hereunder described by reference to the drawings.

In the present invention, a side of a connector terminal to be inserted into a connector housing is taken as a front side, whilst another side of the connector terminal to be connected to an electric wire is taken as a rear side.

First Embodiment

Figure 1A:
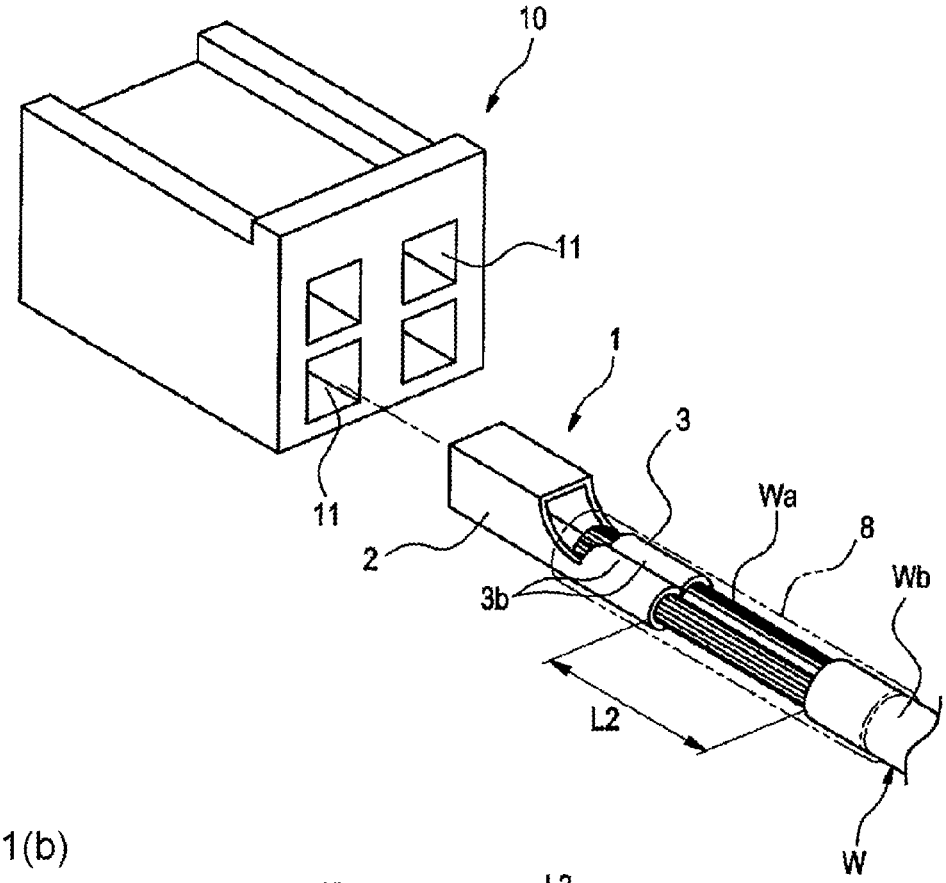
FIG. 1(*a*) and FIG. 1(*b*) show an electric wire connection structure of a connector terminal of a first embodiment of the present invention, wherein FIG. 1(*a*) is a perspective view showing that a connector terminal with an end of an electric wire is about to be inserted into a terminal accommodating chamber of a connector housing, and FIG. 1(*b*) is a side cross sectional view of the terminal accommodating chamber into which the connector terminal is inserted.
Figure 1B:
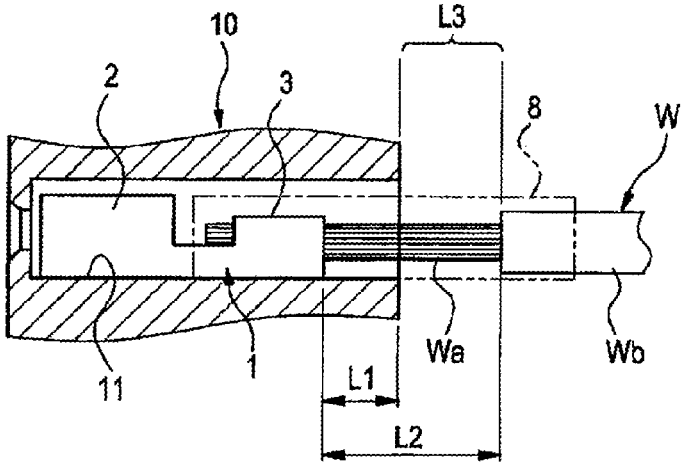
Figure 2A:
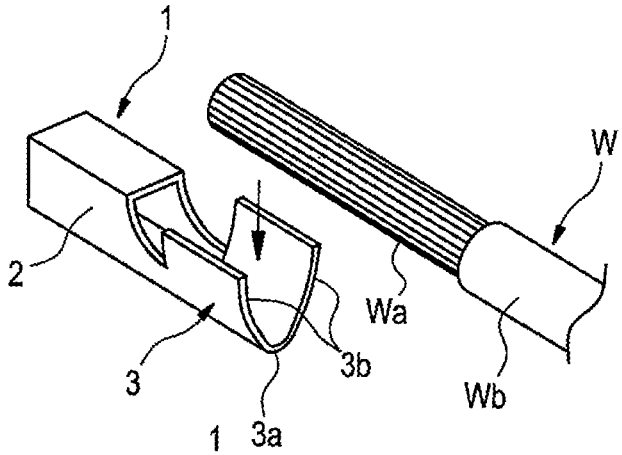
FIG. 2(*a*) to FIG. 2(*c*) are explanatory flow diagrams through which the electric wire connection structure of the embodiment is produced, wherein FIG. 2(*a*) is a perspective view showing that a conductor of an electric wire from which an insulated sheath is cut off is about to be placed on an electric wire connection section of the connector terminal, FIG. 2(*b*) is a perspective view showing that the electric wire is crimped and connected with crimping pieces of the electric wire connection section after the conductor is placed on the electric wire connection section, and FIG. 2(*c*) is a perspective view showing that the connection portion of the electric wire is further coated with a resin (designated by a chain double-dashed line).
Figure 2B:
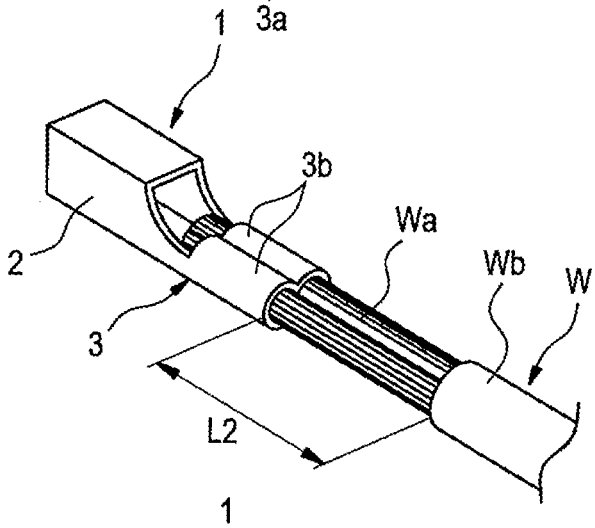
Figure 2C:
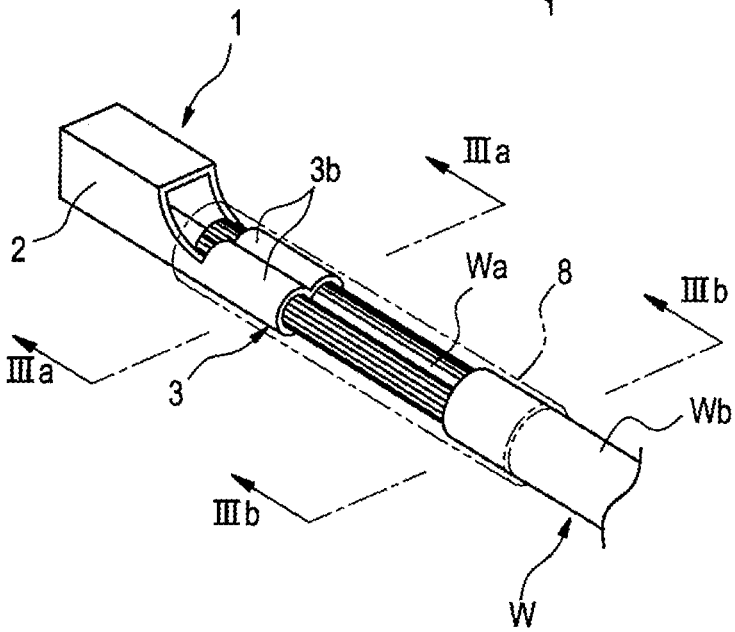
Figure 3A:
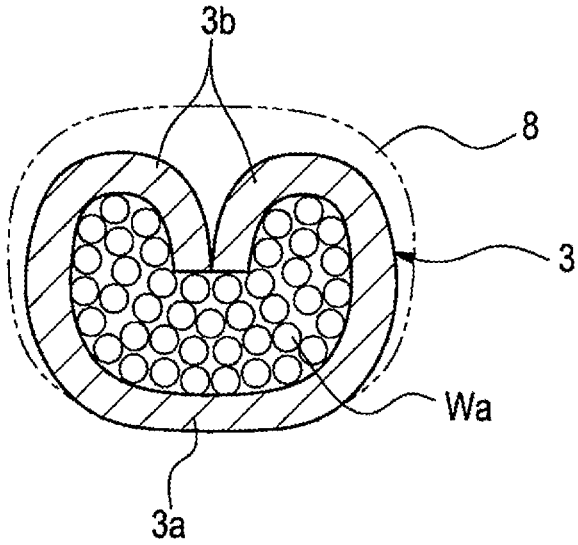
FIG. 3(*a*) is a cross section acquired when viewed along a direction of arrows IIIa-IIIa shown in FIG. 2(*c*), and FIG. 3(*b*) is a cross section acquired when viewed along a direction of arrows IIIb-IIIb shown in FIG. 2(*c*).
Figure 3B:
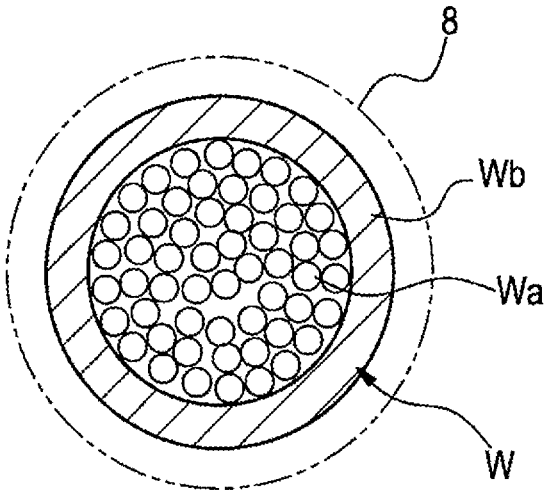

FIG. 1(*a*) and FIG. 1(*b*) show an electric wire connection structure of a connector terminal of a first embodiment, wherein FIG. 1(*a*) is a perspective view showing that a connector terminal with an end of an electric wire is about to be inserted into a terminal accommodating chamber of a connector housing, and FIG. 1(*b*) is a side cross sectional view of the terminal accommodating chamber into which the connector terminal is inserted. FIG. 2(*a*) to FIG. 2(*c*) are explanatory flow diagrams through which the electric wire connection structure of the embodiment is produced, wherein FIG. 2(*a*) is a perspective view showing that a conductor of an electric wire from which an insulated sheath is cut off is about to be placed on an electric wire connection section of the connector terminal, FIG. 2(*b*) is a perspective view showing that the electric wire is crimped and connected with crimping pieces of the electric wire connection section after the conductor is placed on the electric wire connection section, and FIG. 2(*c*) is a perspective view showing that the connection portion of the electric wire is further coated with a resin (designated by a chain double-dashed line). FIG. 3(*a*) is a cross section acquired when viewed along a direction of arrows IIIa-IIIa shown in FIG. 2(*c*), and FIG. 3(*b*) is a cross section acquired when viewed along a direction of arrows IIIb-IIIb shown in FIG. 2(*c*). The electric wire connection structure of the first embodiment is realized by crimping an end of an electric wire W to a rear end of a connector terminal 1 to be inserted into a terminal accommodating chamber 11 of a connector housing 10 from behind and sealing with a molding resin 8 a portion of the terminal accommodating chamber 11 to which the connector terminal is connected.

First, as shown in FIG. 1(*a*) and FIG. 1(*b*), an insulated sheath Wb of the end of the electric wire W is removed from an extremity of the end of the electric wire W up to a location where the electric wire W projects backward from a rear end of the terminal accommodating chamber 11 of the connector housing 10 in the electric wire connection structure. Provided that a distance from a rear end of the connector terminal 1 to a rear end of the terminal accommodating chamber 11 achieved when the connector terminal 1 is accommodated in the terminal accommodating chamber 11 of the connector housing 10 is taken as L1, a distance L2 from the rear end of the connector terminal 1 to an edge of an insulated sheath Wb achieved while the electric wire W is connected to the connector terminal 1 fulfills a relationship of L1<L2. Therefore, the conductor Wa projects from the rear end of the terminal accommodating chamber 11 while being exposed by a dimension of L3=L2−L1.

In the meantime, the connector terminal 1 has in a front portion along its longitudinal direction an electric connection section 2 to be connected to a terminal of a counterpart connector and in a rear portion an electric wire connection section 3 to be crimped to the conductor Wa of the end of the electric wire W. As shown in FIG. 2(*a*), the electric wire connection section 3 is formed, so as to assume a substantially U-shaped profile when viewed in cross section, from a bottom plate 3*a* that is continual from the electric connection section 2 and a pair of crimping pieces 3*b* and 3*b* that extend upwards from both side edges of the bottom plate 3*a* and are to be crimped so as to enwrap the conductor Wa put on an interior surface of the bottom plate 3*a*.

The electric wire connection structure of the first embodiment is configured as follows. As shown in FIG. 2(*a*) and FIG. 2(*b*), the conductor Wa of the electric wire W that is exposed by removal of the insulated sheath Wb is put on an upper surface of the bottom plate 3*a* of the electric wire connection section 3 of the connector terminal 1. The pair of crimping pieces 3*b*, 3*b* are curled inwards so as to enwrap the conductor Wa and then crimped such that the conductor Wa comes into close contact with the upper surface of the bottom plate 3*a*. As shown in FIG. 2(*c*), an area that ranges from an extremity of the conductor Wa up to the edge of the insulated sheath Wb formed after removal by way of a portion of the conductor Wa crimped to the connector terminal 1 is sealed with the resin 8. A portion of the electric wire connection structure corresponding to the electric wire connection section 3 assumes at this time a cross sectional profile, such as that illustrated in FIG. 3(*a*), and the portion of the electric wire W covered with the insulated sheath Wb assumes at this time a cross sectional profile, such as that illustrated in FIG. 3(*b*).

Figure 4:
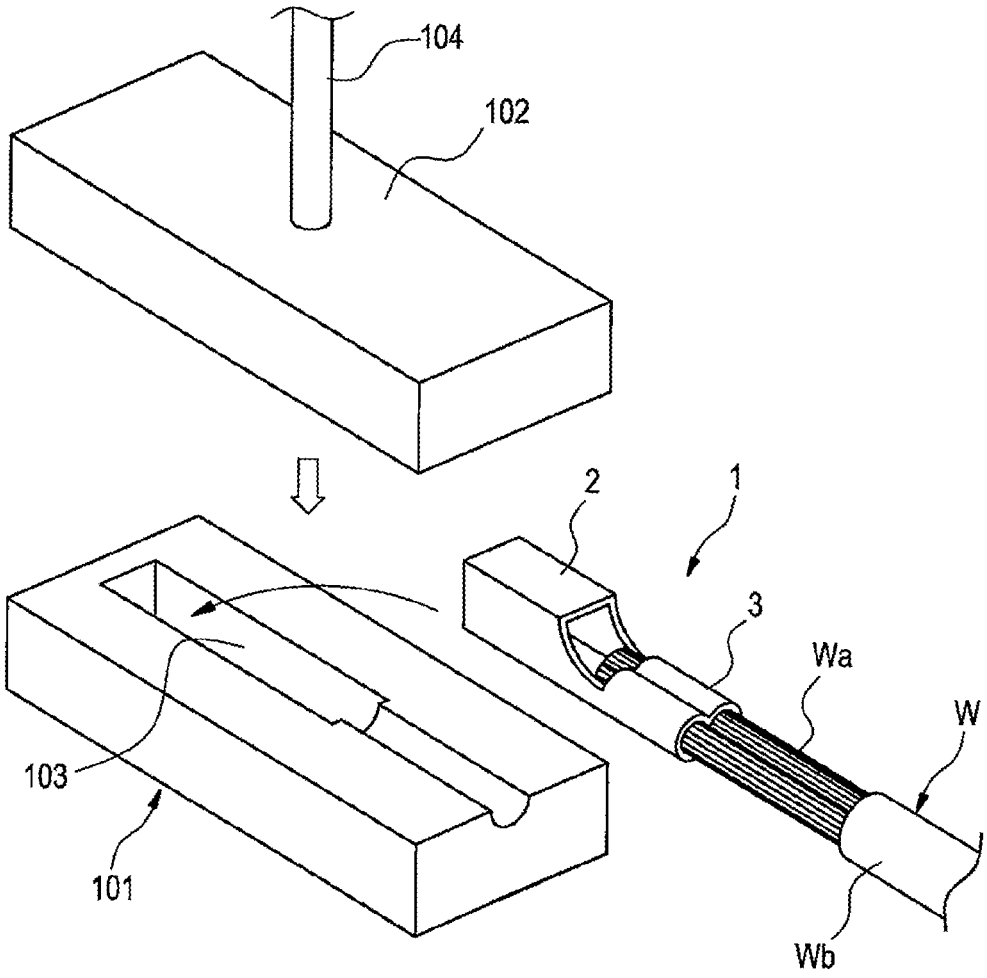
FIG. 4 is a perspective view showing that a portion of the connector terminal to which the electric wire is connected is about to be molded from a resin.

A coating method or a molding method involving usage of a die assembly can be selected as a method for providing a coating of the resin 8. FIG. 4 is a descriptive view of a molding method involving usage of the die assembly. The connector terminal 1 connected to the end of the electric wire W is set in a cavity 103 of a lower mold 101, and an upper mold 102 is put on the lower mold, thereby closing the die assembly. A molten resin is poured into the closed die assembly from an inlet 104 of the upper mold 102. The upper mold 102 is presumed to have a partition wall, which is omitted from the drawing, to prevent an overflow of a resin to an unwanted area. The resin 8 is thus poured and cured, whereby the electric wire connection structure in which the electric wire connection structure 3 and the conductor Wa are sealed with the resin 8 is thus completed. A thermoplastic elastomer, or the like, can be named as a type of the resin 8 to be used.

In the thus-configured electric wire connection structure, the insulated sheath Wb of the electric wire W is removed from the extremity of the end of the electric wire W to the location where the electric wire projects backwards from the rear end of the terminal accommodating chamber 11 of the connector housing 10. The portion of the electric wire W accommodated in the terminal accommodating chamber 11 can be limited to solely to a portion of the conductor Wa that is not covered with the insulated sheath Wb. A cross section of the portion can be made smaller when compared with a case where the conductor is covered with the insulated sheath Wb. Specifically, as in case with the related art, when the electric wire is crimped to the connector terminal 1 while the conductor Wa is accommodated in the terminal accommodating chamber 11 up to a location where the conductor Wa is covered with the insulated sheath Wb, a cross section of the crimped portion becomes large by an amount tantamount to the thickness of the insulated sheath Wb. When the connector terminal 1 is crimped to an area where only the conductor Wa is exposed without the insulated sheath Wb, the cross section of the thus-crimped area can be reduced by an amount corresponding to the thickness of the thus-removed insulated sheath Wb.

Accordingly, even when the area where the connector terminal 1 is connected to the electric wire W is covered with the sealing resin 8, the cross section of the electric wire W including the resin 8 can be kept small, so that the connector terminal can be easily, smoothly inserted into the terminal accommodating chamber 11 of the connector housing 10. This also makes it possible to contribute to miniaturization of the connector housing 10. Since the portion of the electric wire W projecting from a rear end of the connector terminal 1 is only the conductor Wa, the portion can be coated with the resin 8 to a thickness equal to the thickness of the insulated sheath Wb. Further, a bottom surface side of the electric wire W contiguous to the bottom surface side of the connector terminal 1 can also be provided with the resin 8. An entire circumference of the conductor Wa can be enwrapped with the resin 8, so that the exposed portion of the conductor Wa can be protected by the resin 8 without fail.

For this reason, even when the connector terminal 1 and the conductor Wa of the electric wire W are formed from dissimilar metals (for instance, when the connector terminal 1 is formed from copper or a copper alloy and when the conductor Wa of the electric wire is formed from aluminum or an aluminum alloy), electric corrosion of a contact between the dissimilar metals can be prevented by the sealing effect of the resin 8. Moreover, since the entire exposed portion of the conductor Wa is covered with the resin 8, corrosion of the conductor Wa can be inhibited, and waterproofing of the electric wire W (intrusion of water into space among core wires of the conductor Wa can be prevented).

Figure 5:
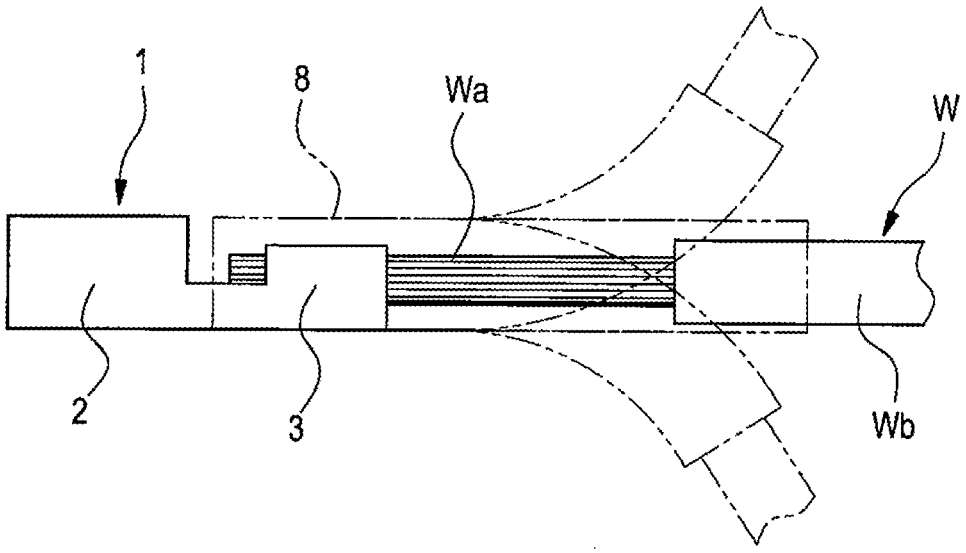
FIG. 5 is a side view for showing that compensating for absence of a cladding crimping section is effected by coating with a resin a conductor that extends from a rear end of the connector terminal.
Figure 6A:
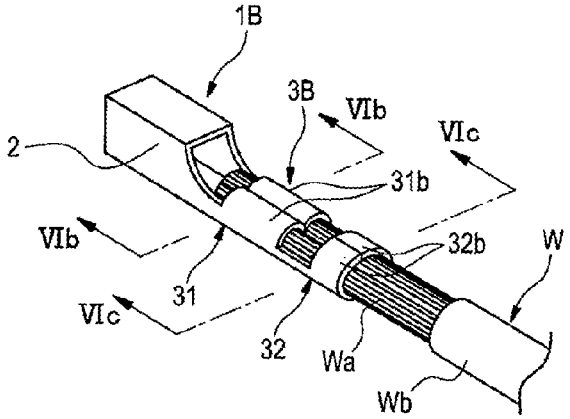
FIGS. 6(*a*) to 6(*d*) are explanatory views of a second embodiment in which the present invention is applied to a connector terminal, like a common terminal, having a conductor crimping section and a cladding crimping section, wherein FIG. 6(*a*) is a perspective view showing that a conductor is crimped with the conductor crimping section and the cladding crimping section, FIG. 6(*b*) is a cross section acquired when viewed along a direction of arrows VIb-VIb shown in FIG. 6(*a*), FIG. 6(*c*) is a cross section acquired when viewed along a direction of arrows VIc-VIc shown in FIG. 6(*a*), and FIG. 6(*d*) is a perspective view showing that the portion of the connector terminal to which the electric wire is connected is further covered with a resin (designated by chain double-dashed lines).
Figure 6B:
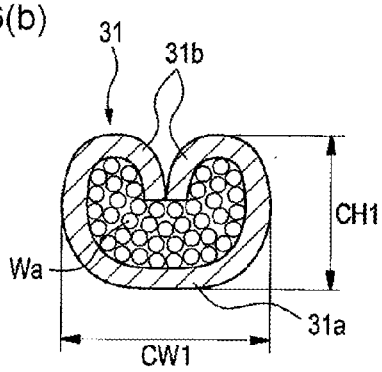
Figure 6C:
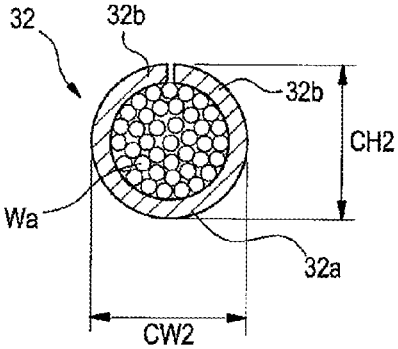
Figure 6D:
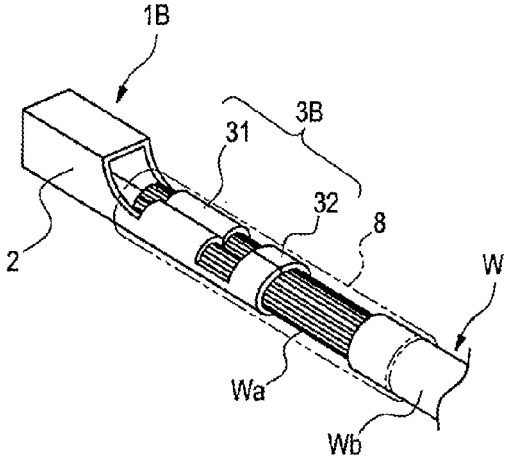

As shown in FIG. 5, since the sealing resin 8 covers an extent from the extremity of the conductor Wa to a location including the edge of the insulated sheath Wb formed after removal, the resin 8 used for coating can compensate for strength and flexibility of the extent from the rear end of the connector terminal 1 to the edge of the insulated sheath Wb formed after removal, where only the conductor Wa is exposed. Further, even when the electric wire W is bent as designated by chain double-dashed lines, the conductor Wa can be flexibly protected by the resin 8.

Second Embodiment

FIG. 6(*a*) to FIG. 6(*d*) are explanatory views of a second embodiment in which the present invention is applied to a connector terminal, like a common terminal, having a conductor crimping section and a cladding crimping section, wherein FIG. 6(*a*) is a perspective view showing that a conductor is crimped with the conductor crimping section and the cladding crimping section, FIG. 6(*b*) is a cross section acquired when viewed along a direction of arrows Vib-Vib shown in FIG. 6(*a*), FIG. 6(*c*) is a cross section acquired when viewed along a direction of arrows VIc-VIc shown in FIG. 6(*a*), and FIG. 6(*d*) is a perspective view showing that the portion of the connector terminal to which the electric wire is connected is further covered with a resin (designated by chain double-dashed lines).

The connector terminal 1 used in the first embodiment has only one conductor crimping section as an electric wire connection section. In contrast, an electric wire connection section 3B of a connector terminal 1B employed in the second embodiment has a first conductor crimping section 31 as a forefoot and a second conductor crimping section 32 situated behind the first conductor crimping section 31 as a rear foot. The second conductor crimping section 32 is the equivalent of a cladding crimping section of the related terminal.

The rear foot provided as the cladding crimping section in the related art is used as the second conductor crimping section 32 in the second embodiment. The conductor Wa that is exposed as a result of the insulated sheath Wb being cut in a longer length than in the related art is crimped by means of a bottom plate 32*a* and a pair of conductor crimping pieces 32*b* of the second conductor crimping section 32.

On the occasion, crimping is performed in such a way that a cross section of the second conductor crimping section 32 shown in FIG. 6(*c*) becomes equal to or smaller than a cross section of the first conductor crimping section 31 shown in FIG. 6(*b*). Provided that a height of the first conductor crimping section 31 is CH1; that a width of the first conductor crimping section 31 is CW1; that a height of the second conductor crimping section 32 is CH2; and that a width of the second conductor crimping section 32 is CW2, we have $$CH1 \geq CH2$$

$$CW1 \geq CW2.$$

As shown in FIG. 6(*a*) to FIG. 6(*c*), an electric wire connection structure of the second embodiment is realized by placing the conductor Wa of the electric wire W exposed as a result of removal of the insulated sheath Wb on an upper surface of a bottom plate 31*a* of the first conductor crimping section 31 and an upper surface of a bottom plate 32*a* of the second conductor crimping section 32 of the connector terminal 1; curling the pair of conductor crimping pieces 31*b* and 32*b* inwardly so as to enwrap the conductor Wa; crimping the conductor Wa such that the conductor Wa remains in close contact with an upper surface of the bottom plate 31*a* and an upper surface of the bottom plate 32*a*; and covering, in a manner shown in FIG. 6(*d*), with the resin 8 an extent from the extremity of the conductor Wa to the location including the edge of the insulated sheath Wb formed after removal, by way of an area where the conductor Wa is crimped to the connector terminal 1.

A working effect analogous to that yielded in the first embodiment can also be yielded even in the second embodiment. In particular, in the second embodiment, an advantage for enhancing force for supporting the conductor Wa can be yielded as a result of provision of the second conductor crimping section 32.

Third Embodiment

Figure 7A:
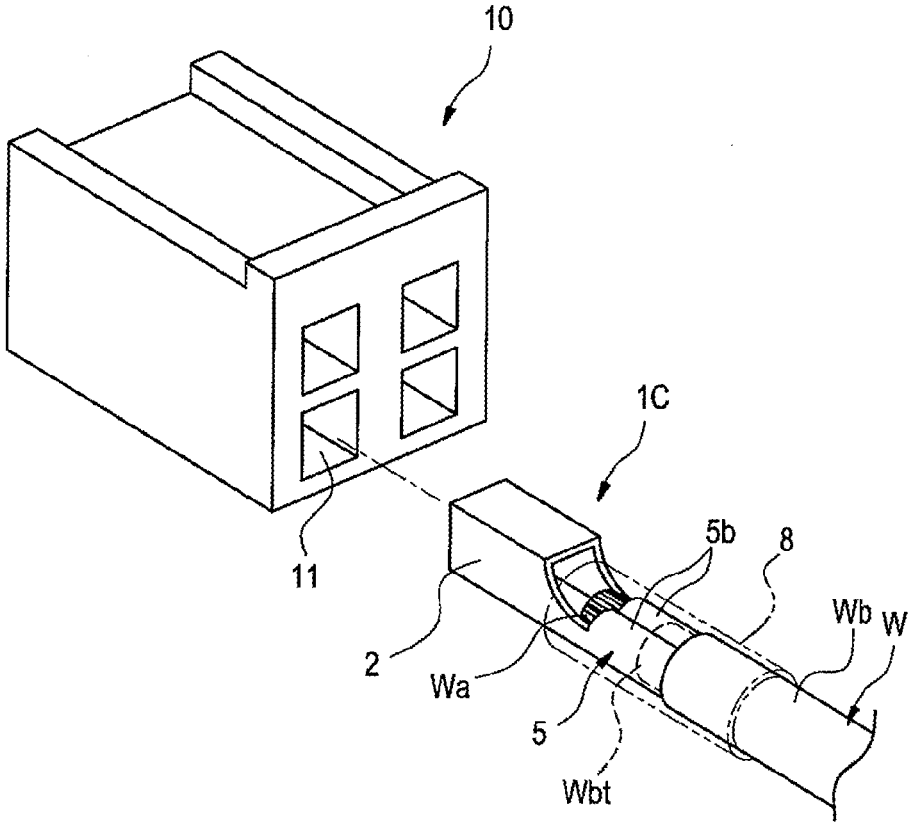
FIGS. 7(*a*) and 7(*b*) show an electric wire connection structure of a connector terminal of a third embodiment of the present invention, wherein FIG. 7(*a*) is a perspective view showing that a connector terminal with an end of an electric wire is about to be inserted into the terminal accommodating chamber of the connector housing, and FIG. 7(*b*) is a side cross section of the terminal accommodating chamber into which the connector terminal is inserted.
Figure 7B:
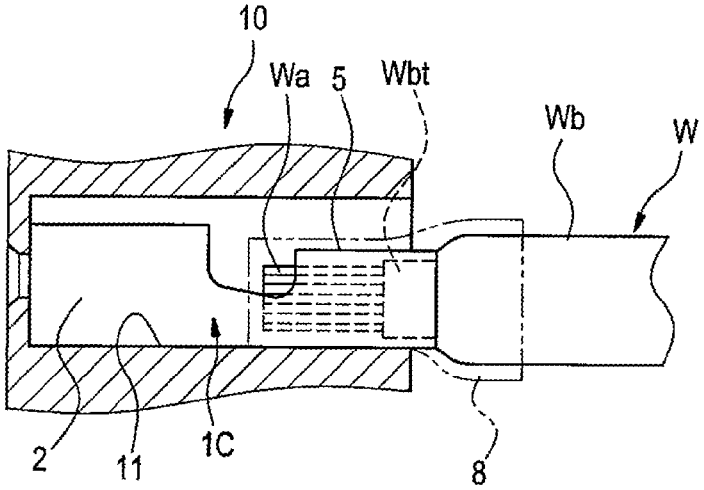
Figure 8A:
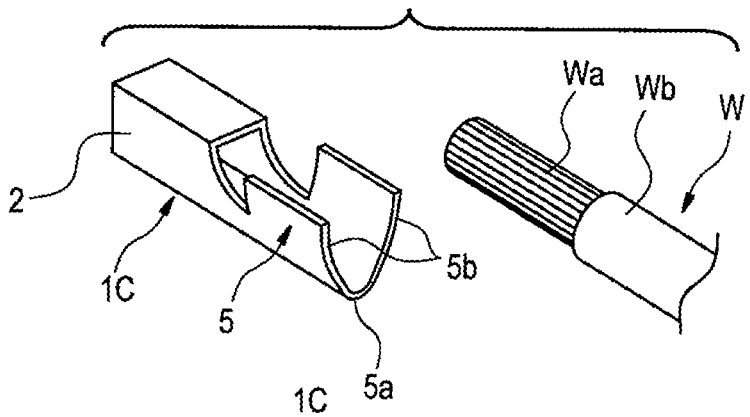
FIGS. 8(*a*) to 8(*c*) are explanatory flow diagrams through which the electric wire connection structure of the third embodiment is produced, wherein FIG. 8(*a*) is a perspective view showing that a conductor of an electric wire from which an insulated sheath is cut off is about to be placed on an electric wire connection section of the connector terminal, FIG. 8(*b*) is a perspective view showing that the electric wire is crimped and connected with crimping pieces of the electric wire connection section after the conductor is placed on the electric wire connection section, and FIG. 8(*c*) is a perspective view showing that the connection portion of the crimped electric wire is further coated with a resin (designated by chain double-dashed lines).
Figure 8B:
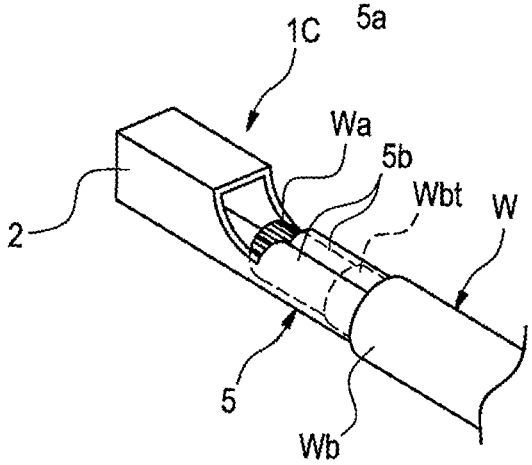
Figure 8C:
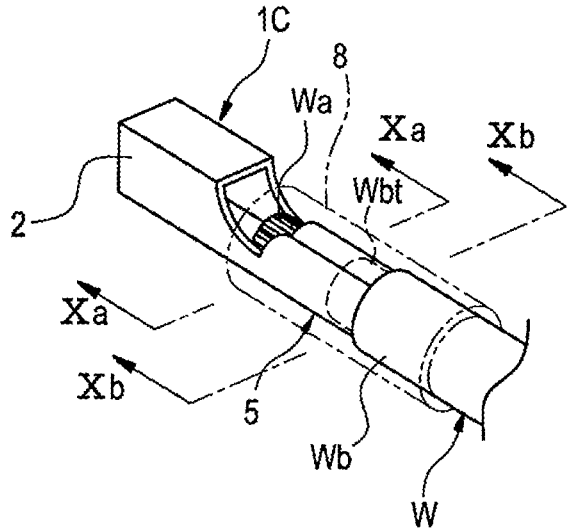
Figure 9:
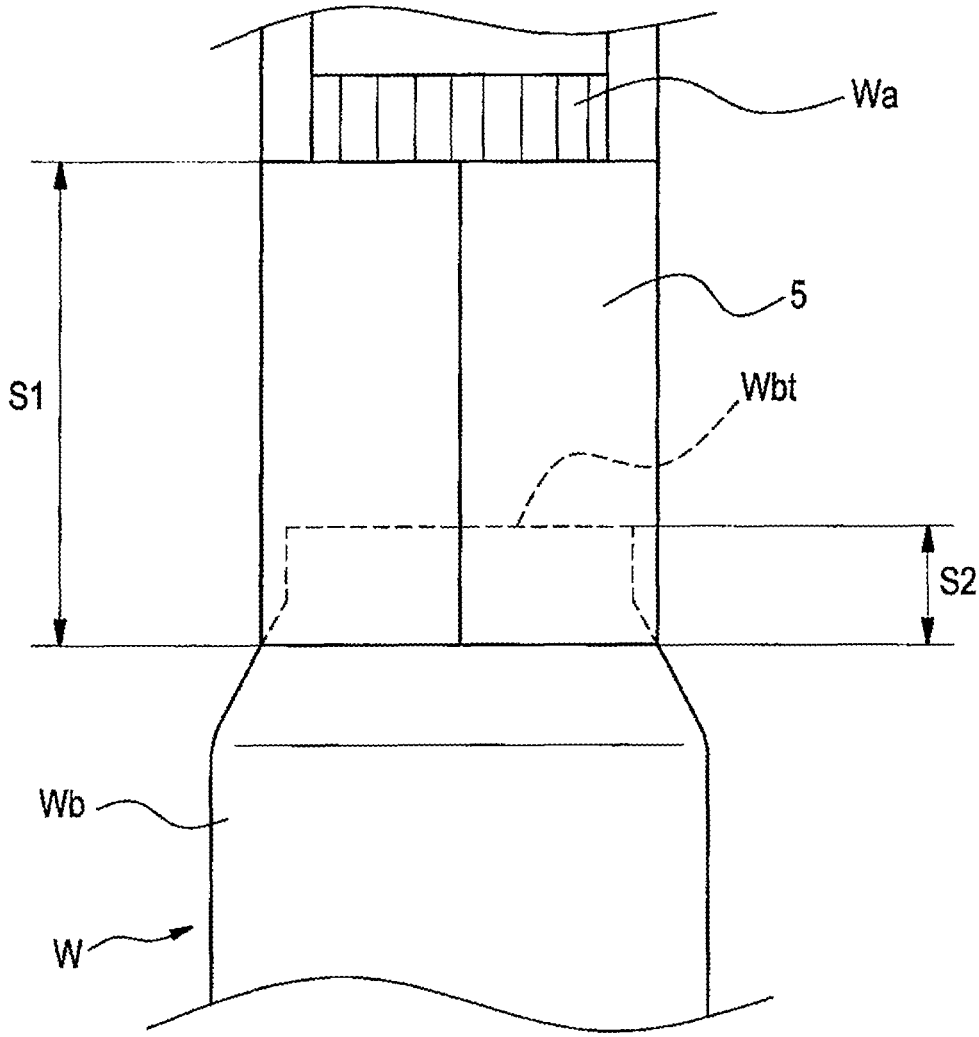
FIG. 9 is a top view showing an area where the electric wire is crimped and connected by means of the electric wire connection section of the third embodiment from above.
Figure 10A:
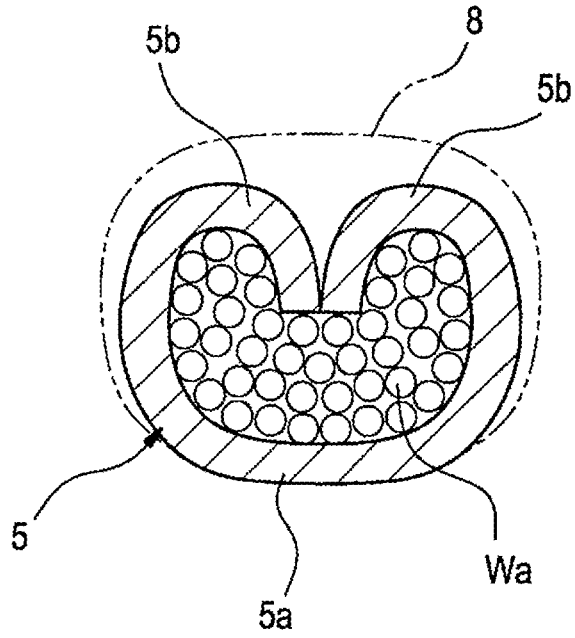
FIG. 10(*a*) is a cross section acquired when viewed along a direction of arrows Xa-Xa shown in FIG. 8(*c*), and FIG. 10(*b*) is a cross section acquired when viewed along a direction of arrows Xb-Xb shown in FIG. 8(*c*).
Figure 10B:
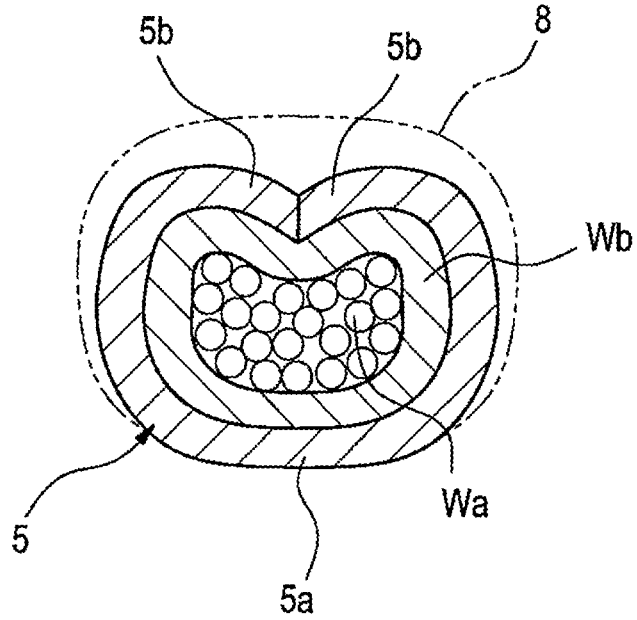
Figure 11A:
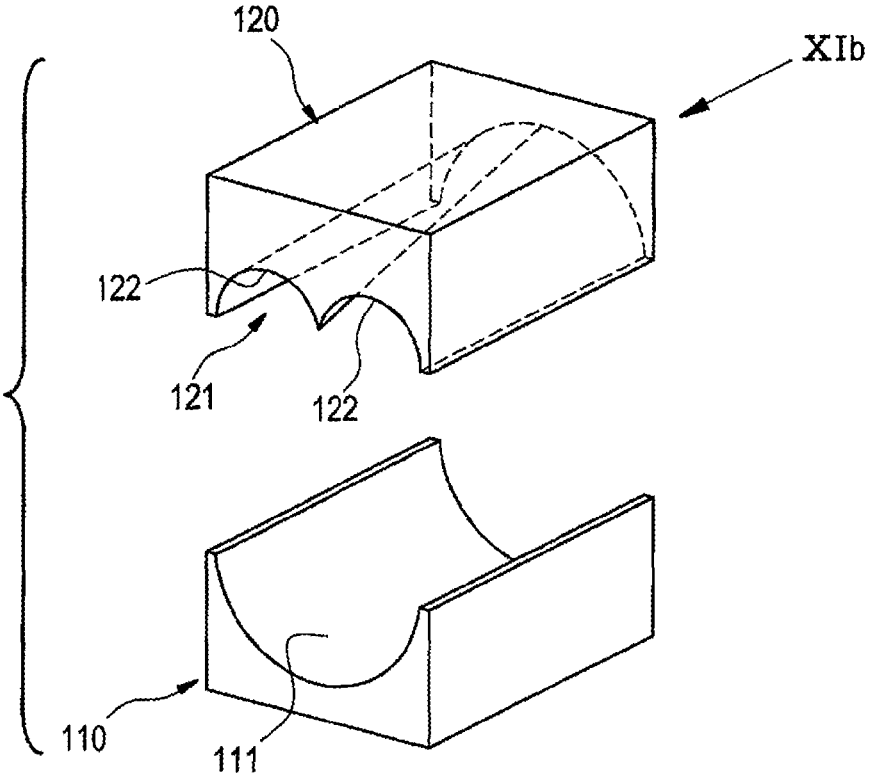
FIGS. 11(*a*) and 11(*b*) are structural diagrams of a resin mold die assembly for producing the electric wire connection section of the third embodiment, wherein FIG. 11(*a*) is a perspective view showing a relationship between a lower mold and an upper mold, and FIG. 11(*b*) is a view of the upper mold acquired when viewed along a direction of arrow XIb shown in FIG. 11(*a*).
Figure 11B:
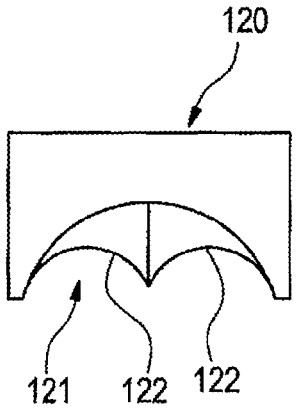

FIGS. 7(*a*) and 7(*b*) show an electric wire connection structure of a connector terminal of a third embodiment, wherein FIG. 7(*a*) is a perspective view showing that a connector terminal with an end of an electric wire is about to be inserted into the terminal accommodating chamber of the connector housing, and FIG. 7(*b*) is a side cross section of the terminal accommodating chamber into which the connector terminal is inserted. FIGS. 8(*a*) to 8(*c*) are explanatory flow diagrams through which the electric wire connection structure of the third embodiment is produced, wherein FIG. 8(*a*) is a perspective view showing that a conductor of an electric wire from which an insulated sheath is cut off is about to be placed on an electric wire connection section of the connector terminal, FIG. 8(*b*) is a perspective view showing that the electric wire is crimped and connected with crimping pieces of the electric wire connection section after the conductor is placed on the electric wire connection section, and FIG. 8(*c*) is a perspective view showing that the connection portion of the electric wire is further coated with a resin (designated by chain double-dashed lines). FIG. 9 is a top view showing an area where the electric wire is crimped and connected by means of the electric wire connection section of the third embodiment. FIG. 10(*a*) is a cross section acquired when viewed along a direction of arrows Xa-Xa shown in FIG. 8(*c*), and FIG. 10(*b*) is a cross section acquired when viewed along a direction of arrows Xb-Xb shown in FIG. 8(*c*). FIGS. 11(*a*) and 11(*b*) are structural diagrams of a resin mold die assembly for producing the electric wire connection section of the third embodiment, wherein FIG. 11(*a*) is a perspective view showing a relationship between a lower mold and an upper mold, and FIG. 11(*b*) is a view of the upper mold acquired when viewed along a direction of arrow XIb shown in FIG. 11(*b*).

As shown in FIG. 7(*a*) and FIG. 7(*b*), the electric wire connection structure of the third embodiment is embodied such that the end of the electric wire W is crimped and connected to a rear end of a connector terminal 1C to be inserted from behind into the terminal accommodating chamber 11 of the connector housing 10 and that a portion of the connector terminal 1C to which the end of the electric wire W is connected is sealed with the molding resin 8.

First, as shown in FIG. 8(*a*), the connector terminal 1C employed in the third embodiment has in a front portion the electric connection section 2 for connection with a terminal of the counterpart connector and in a rear portion a longish electric wire connection section 5 to be crimped to the conductor Wa of the end of the electric wire W. The electric wire connection section 5 is formed so as to have a substantially U-shaped profile when viewed in cross section from a bottom plate 5*a* continued from the electric connection section 2 and a pair of crimping pieces 5*b*, 5*b* that extend upwards from both side edges of the bottom plate 5*a* and are to be crimped so as to enwrap the end of the electric wire W put on an inner surface of the bottom plate 5*a*.

As shown in FIG. 8(*a*) and FIG. 8(*b*), the electric wire connection structure of the third embodiment is embodied by putting both the conductor Wa of the electric wire W exposed as a result of removal of the insulated sheath Wb and the portion of the electric conductor covered with the insulated sheath Wb on the upper surface of the bottom plate 5*a* of the electric wire connection section 5 of the connector terminal 10, inwardly curling the pair of crimping pieces 5*b*, 5*b* in this state so as to enwrap the conductor Wa and the portion of the conductor Wa covered with the insulated sheath Wb all together, crimping the conductor Wa and the insulated sheath Wb so as to come into close contact with the upper surface of the bottom plate 5*a*, and covering an extent from the extremity of the conductor Wa to the portion including the rear end of the electric wire connection section 5 with the resin 8 as shown in FIG. 8(*c*). Either a coating method or a molding method using a die assembly can be used as the method for covering the conductor and the portion of the conductor with the insulated sheath with the resin 8.

In this case, in the electric wire connection section 5, the conductor Wa of the end of the electric wire W and a portion of the conductor covered with the insulated sheath Wb are crimped so as to become smaller than a cross section of the electric wire W extending backwards from the electric wire connection section 5. Namely, there stands a relationship of: a size of the cross section of the electric wire W>a size of the cross section of the electric wire connection section 5. A portion of the electric wire connection section 5 crimped to the conductor Wa assumes at this time a cross section, such as that shown in FIG. 10(*a*). Further, a portion of the electric wire connection section 5 crimped to the insulated sheath Wb assumes a cross section, such as that shown in FIG. 10(*b*). As shown in FIG. 9, it is preferable that a length S2 of an insulated sheath Wb to be inserted into the electric wire connection section 5 be a maximum of about one-haft an entire length S1 of the electric wire connection section 5.

A die assembly, such as that shown in FIG. 11(*a*) and FIG. 11(*b*), can be used as a crimping die to be used on that occasion. In the crimping die assembly shown in FIG. 11(*a*) and FIG. 11(*b*), an indented groove 111 for receiving the bottom plate 5*a* of the electric wire connection section 5 is formed in a lower mold 110, and a crimping groove 121 for inwardly curling the pair of crimping pieces 5*b*, 5*b* is formed in an upper mold 120.

The crimping groove 121 is made by combination of two indented curved grooves 122 and 122. In a front portion of the crimping groove 121 that crimps the pair of crimping pieces 5*b*, 5*b* solely to the conductor Wa, the indented curved grooves 122, 122 are deep, and a peak serving as a demarcation between the curved grooves is formed high. In a rear portion that crimps the pair of crimping pieces 5*b*, 5*b* to the portion of the conductor Wa covered with the insulated sheath Wb, the indented curved grooves 122, 122 are formed, by contrast, so as to become shallow such that the peak serving as a demarcation becomes lower.

As a result of use of the crimping die assembly (the lower mold 110 and the upper mold 120), an area where the conductor Wa is crimped assumes, as shown in FIG. 10(*a*), a cross sectional profile in which extremities of the pair of crimping pieces 5*b*, 5*b* bite into the conductor Wa, and an area where the insulated sheath Wb is crimped assumes, as shown in FIG. 10(*b*), a cross sectional profile in which the extremities of the pair of crimping pieces 5*b*, 5*b* merely butt against each other and not bite into the insulated sheath Wb.

In the electric wire connection structure of the connector terminal 1C configured as mentioned above, the area of the end of the electric wire W covered with the insulated sheath Wb is crimped to the electric wire connection section 5 along with the exposed conductor Wa. The cross section of the area to which the coating is crimped is set so as to become smaller than the cross section of the electric wire W that extends backwards from the electric wire connection section 5. Accordingly, even when the electric wire connection section is coated with the resin 8, the cross section including the resin 8 can be kept small, so that the connector terminal 1C can be easily, smoothly inserted into the terminal accommodating chamber 11 of the connector housing 10. Since the portion of the conductor covered with the insulated sheath Wb is also crimped by means of the electric wire connection section 5 along with the exposed portion of the conductor, the area of the exposed portion of the conductor Wa can be minimized and protected against corrosion. Accordingly, even when the connector terminal is covered with the resin 8, it becomes possible to readily perform operation for molding and coating the resin 8. Moreover, since the area of the connector terminal from the extremity of the conductor Wa up to the position including the rear end of the electric wire connection section 5 is covered with the resin 8, electric corrosion of a contact between the conductor Wa and the connector terminal 1C can be prevented.

Figure 12A:
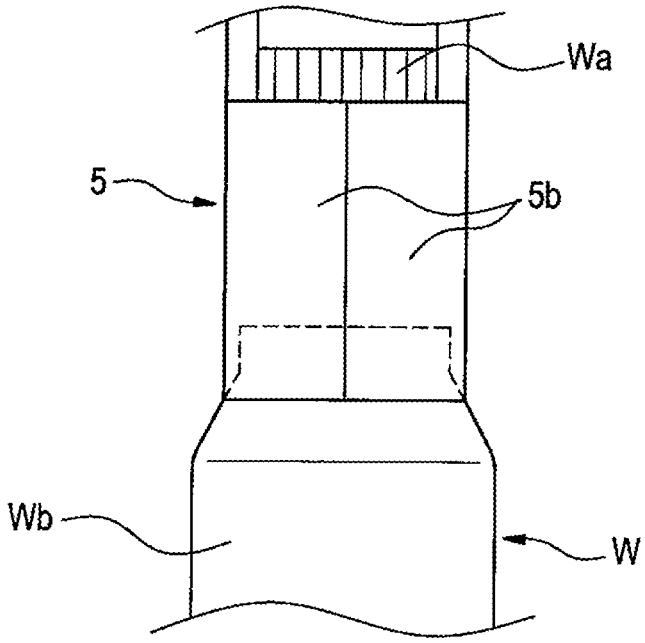
FIGS. 12(*a*) and 12(*b*) are top views of an area where the electric wire is crimped and connected by means of the electric wire connection section of the third embodiment, wherein FIG. 12(*a*) is a view for explaining a case where corners of the crimping piece are not chamfered, and FIG. 12(*b*) is a view for explaining a case where the corners of the crimping piece are chamfered.
Figure 12B:
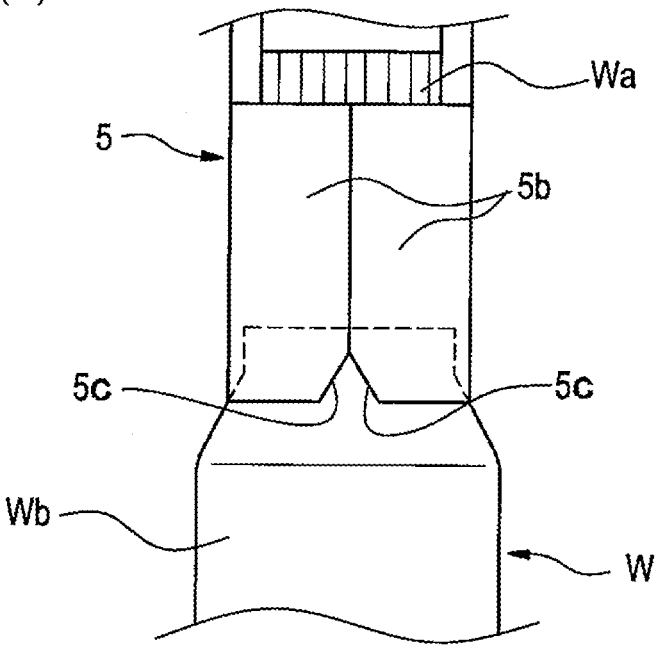

As shown in FIG. 12(*b*), when an obliquely cut chamfered area 5*c* is formed in each of corners where upper and rear edges of the pair of crimping pieces 5*b*, 5*b*, which make up the electric wire connection section 5 assuming a substantially U-shaped profile when viewed in cross section, cross each other, an extent to which the corners of the crimping pieces 5*b*, 5*b* bite into the electric wire W is reduced when compared with a case where the chamfered portions are not provided, such as that shown in FIG. 12(*a*), so that the insulated sheath Wb of the electric wire W can be prevented from undergoing flaws.

Figure 13A:
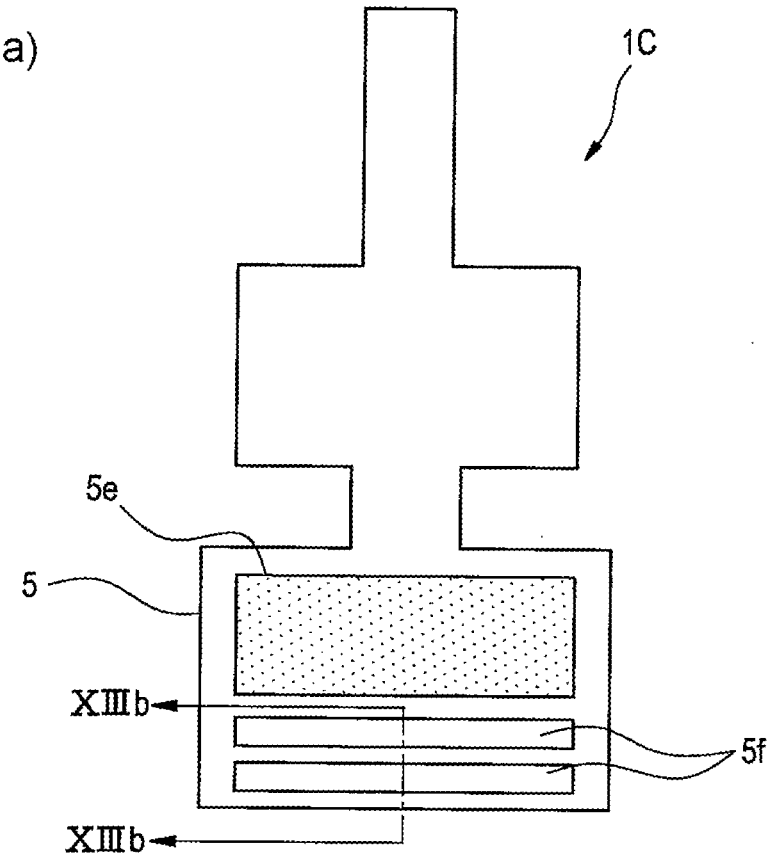
FIG. 13(*a*) is a development elevation of the connector terminal used in the third embodiment, and FIG. 13(*b*) is a cross section of the connector terminal acquired when viewed along a direction of arrows XIIIb-XIIIb shown in FIG. 13(*a*).
Figure 13B:
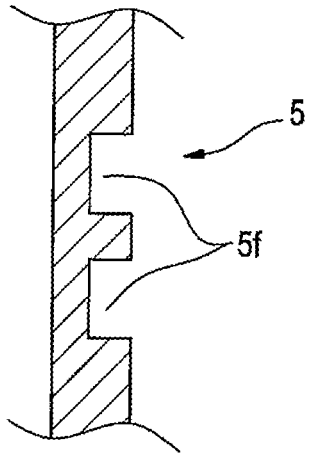
Figure 14:
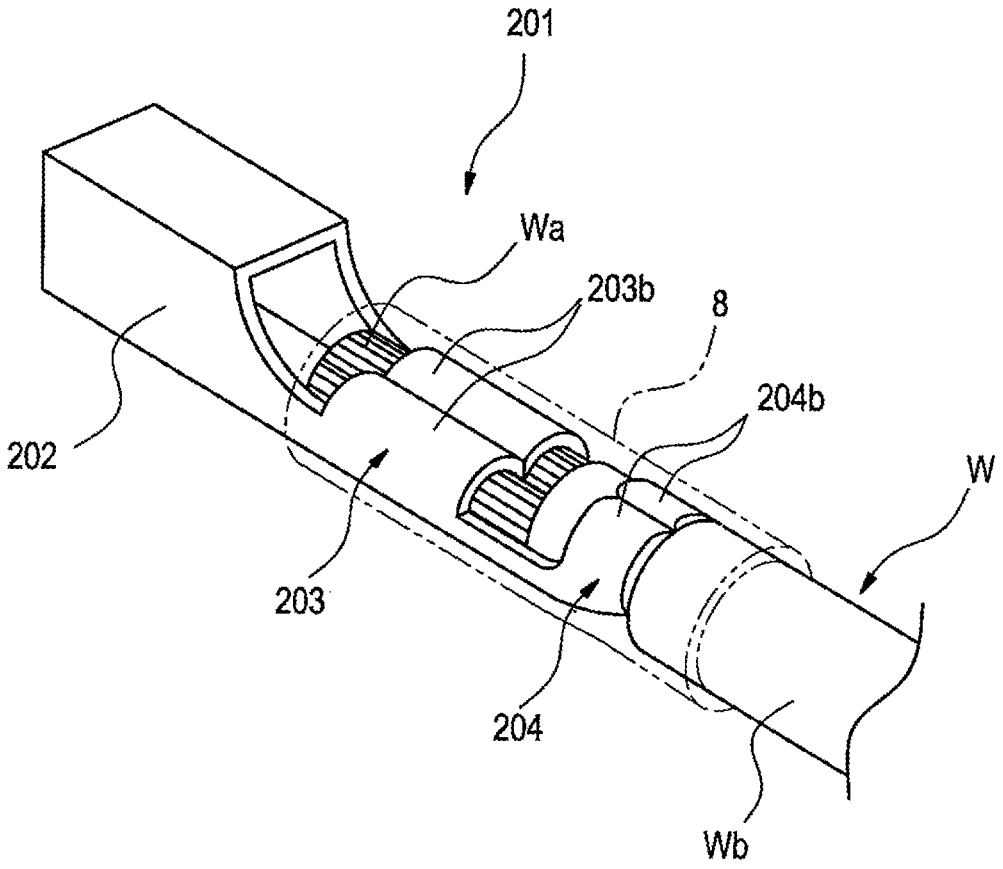
FIG. 14 is a perspective view showing that a commonly used related-art connector terminal is connected to an electric wire.

As shown in FIG. 13(*a*) and FIG. 13(*b*), raised or indented strips 5*f*, which extend in a direction crossing a longitudinal direction of the electric wire, are formed in an area of an internal surface of the electric wire connection section 5 that is to contact the portion of the conductor covered with the insulated sheath Wb. The crimping pieces 5*b* are then crimped to the conductor Wa and the portion of the conductor covered with the insulated sheath Wb, whereby the raised or indented strips 5*f* can be caused to bite into the insulated sheath Wb. In such a case, adhesion between the interior surface of the electric wire connection section 5 and the insulated sheath Wb can be enhanced further. In addition, the raised or indented strips 5*f* extend in a direction crossing the longitudinal direction of the electric wire. Accordingly, even when water attempts to enter deep into the conductor Wa from the rear end of the electric wire connection section 5, a channel of intrusion of water can be shut off by means of a complicate contact structure of the area where the raised or indented strips 5*f* bite into the insulated sheath Wb, thereby impeding intrusion of water and inhibiting corrosion of the conductor Wa. Further, a serration can also be provided in an area 5*e* of the interior surface of the electric wire connection section 5 that contacts the conductor Wa.

The present invention is not limited to the embodiment and susceptible to modifications, alterations, and the like, as required. In addition, respective constituent elements of the embodiments are arbitrary and not limited in view of a material, a shape, a dimension, a quantity, a location, and the like, so long as the present invention can be fulfilled.

What is claimed is:

1. An electric wire connection structure of a connector terminal in which an end of an electric wire is crimped and connected to a rear end of a connector terminal to be inserted, from behind, into a terminal accommodating chamber of a connector housing, the terminal accommodating chamber having a maximum cross-sectional dimension, wherein the connector terminal comprises an electric connection section for connecting with a counterpart terminal in a front portion of the connector terminal, and an electric wire connection section to be crimped and connected to the end of the electric wire in a rear portion of the connector terminal, the electric wire connection section being formed from a bottom plate and a pair of crimping pieces that extend upwards from both side edges of the bottom plate so as to assume a substantially U-shaped profile when viewed in cross section;

an insulated sheath of the end of the electric wire is removed from an extremity of the electric wire to a location where the electric wire projects backwards from a rear end of the terminal accommodating chamber of the connector housing, such that a conductor portion of the electric wire that is not covered by the insulated sheath extends outside of and projects outwardly beyond the rear end of the terminal accommodating chamber when the connector terminal is accommodated in the terminal accommodating chamber of the connector housing;

a conductor of the electric wire exposed by removal of the insulated sheath is put on an upper surface of the bottom plate of the electric wire connection section, and the pair of crimping pieces of the electric wire connection section are curled inwardly so as to enwrap the conductor, whereby the conductor is crimped and connected so as to come into close contact with the upper surface of the bottom plate; and an area that ranges from an extremity of the conductor to a location including an edge of the insulated sheath by a portion of the conductor connected to the electric wire connection section is covered with a resin, wherein the area covered with the resin has a maximum cross-sectional dimension that is less than the maximum cross-sectional dimension of the terminal accommodating chamber.

2. The electric wire connection structure of the connector terminal according to claim 1, wherein the electric wire connection section has a first conductor crimping section in a front portion of the electric wire connection, and a second conductor crimping section in a rear portion of the electric wire connection; the first conductor crimping section has a bottom plate and a pair of conductor crimping pieces that extend upwards from both side edges of the bottom plate, and the second conductor crimping section has a bottom plate and a pair of conductor crimping pieces that extend upwards from both side edges of the bottom plate; and an area that ranges from the bottom plate of the first conductor crimping section to the bottom plate of the second conductor crimping section is formed as a common bottom plate.

3. The electric wire connection structure of the connector terminal according to claim 1, wherein a cross section of the electric wire connection section to which the end of the electric wire is crimped and connected is substantially equal to or smaller than a cross section of the electric connection section.

4. The electric wire connection structure of the connector terminal according to claim 1, wherein the bottom plate of the electric wire connection section is configured to be entirely disposed within the terminal accommodating chamber of the connector housing when the connector terminal is accommodated in the terminal accommodation chamber.

5. The electric wire connection structure of the connector terminal according to claim 4, wherein a rear end of the bottom plate is spaced from the rear end of the terminal accommodation chamber of the connector housing when the connector terminal is accommodated in the terminal accommodation chamber.

6. The electric wire connection structure of the connector terminal according to claim 5, wherein a height of the electric wire connection section is smaller than a height of the terminal accommodation chamber of the connector housing.

7. The electric wire connection structure of the connector terminal according to claim 1, wherein the insulated sheath of the end of the wire is spaced from the rear end of the terminal accommodating chamber of the connector housing.

8. An electric wire connection structure for use with a connector housing that defines a terminal accommodating chamber and that includes a counterpart terminal disposed within the terminal accommodating chamber, and the terminal accommodating chamber has a maximum cross-sectional dimension, the electric wire connection structure comprising:

an electric wire that includes a conductor covered at least in part by an insulated sheath, the electric wire defining a terminal end;

a connector terminal that includes an electric connection section and an electric wire connection section, the connector terminal being configured to be connectable to the electric wire by crimping and to be insertable from behind into the terminal accommodating chamber of the connector housing, the electric connection section being configured for connection to the counterpart terminal disposed within the terminal accommodating chamber, the electric wire connection section being configured to be crimped and connected to the end of the electric wire in a rear portion of the connector terminal, the electric wire connection section being formed from a bottom plate and a pair of crimping pieces that extend upwards from both side edges of the bottom plate so as to assume a substantially U-shaped profile when viewed in cross section; and a resin that is configured to cover the terminal end of the electric wire, the electric wire connection section of the connector terminal, and a portion of the insulated sheath of the electric wire, wherein:

the insulated sheath of the end of the electric wire is configured to be removed from a section defined between the terminal end to a location where the electric wire projects backwards from a rear end of the terminal accommodating chamber of the connector housing, such that a conductor portion of the electric wire that is not covered by the insulated sheath extends outside of and projects outwardly beyond the rear end of the terminal accommodating chamber when the connector terminal is in the terminal accommodating chamber of the connector housing, the conductor of the electric wire that is exposed by removal of the insulated sheath is disposed on an upper surface of the bottom plate of the electric wire connection section, and the pair of crimping pieces of the electric wire connection section are curled inwardly so as to enclose the conductor, whereby the conductor is crimped and connected so as to be in close contact with the upper surface of the bottom plate; and a cross-section of the resin including (1) the electric wire, (2) the electric wire connection section, and (3) the insulated sheath has a maximum dimension that is less than the maximum cross-sectional dimension of the terminal accommodating chamber.

9. The electric wire connection structure of the connector terminal according to claim 8, wherein the bottom plate of the electric wire connection section is configured to be entirely disposed within the terminal accommodating chamber of the connector housing when the connector terminal is accommodated in the terminal accommodation chamber.

10. The electric wire connection structure of the connector terminal according to claim 9, wherein a rear end of the bottom plate is spaced from the rear end of the terminal accommodation chamber of the connector housing when the connector terminal is accommodated in the terminal accommodation chamber.

11. The electric wire connection structure of the connector terminal according to claim 10, wherein a height of the electric wire connection section is smaller than a height of the terminal accommodation chamber of the connector housing.

12. The electric wire connection structure of the connector terminal according to claim 8, wherein the insulated sheath of the end of the wire is spaced from the rear end of the terminal accommodating chamber of the connector housing.

* * * * *